US012279727B1

(12) United States Patent
Qiu et al.

(10) Patent No.: US 12,279,727 B1
(45) Date of Patent: Apr. 22, 2025

(54) FOLDABLE BATHTUB TRAY

(71) Applicant: Dongguan Hong Laitai Plastic Products Co., Ltd., Guangdong (CN)

(72) Inventors: Chunlong Qiu, Guangdong (CN); Xiao Zhang, Guangdong (CN)

(73) Assignee: Dongguan Hong Laitai Plastic Products Co., Ltd., Dongguan (CN)

( * ) Notice: Subject to any disclaimer, the term of this patent is extended or adjusted under 35 U.S.C. 154(b) by 0 days.

(21) Appl. No.: 18/885,773

(22) Filed: Sep. 16, 2024

(30) Foreign Application Priority Data

Aug. 23, 2024 (CN) ..... 202422066540.1

(51) Int. Cl.
*A47K 3/00* (2006.01)
*A47B 3/083* (2006.01)
*A47B 23/00* (2006.01)

(52) U.S. Cl.
CPC ..... *A47K 3/004* (2013.01); *A47B 3/083* (2013.01); *A47B 23/001* (2013.01); *A47B 2003/0835* (2013.01)

(58) Field of Classification Search
CPC ..... A47K 3/004; A47K 3/001; A47B 23/02; A47B 23/04; A47B 5/04; A47B 3/083; A47B 2003/0835; A47B 23/001; A61G 5/1094
USPC ..... 248/448; 4/559
See application file for complete search history.

(56) References Cited

U.S. PATENT DOCUMENTS 2,342,591 A * 2/1944 McLean ..... A47B 3/083 16/343
4,861,102 A * 8/1989 Fuller ..... A47C 7/68 297/188.2
4,874,147 A * 10/1989 Ory ..... E06C 7/14 248/223.41
4,939,799 A * 7/1990 Van Hovel ..... A47K 3/122 4/578.1
5,669,313 A * 9/1997 Cottingham ..... A47K 3/004 108/42
6,065,251 A * 5/2000 Kindrick ..... A47K 3/122 297/14

(Continued)

FOREIGN PATENT DOCUMENTS

CN 104523008 A * 4/2015 ..... A47B 3/083
CN 214048616 U * 8/2021

(Continued)

OTHER PUBLICATIONS

Machine Translation of CN 214048616 (Year: 2021).*
Machine Translation of EP 0360956 (Year: 1990).*

*Primary Examiner* — Taylor Morris

(57) ABSTRACT

The present invention provides a foldable bathtub tray, including a first support plate and a second support plate, where the first support plate and the second support plate are hinged by using a connection assembly; the connection assembly includes a first connection seat, a second connection seat, and a rotating shaft; the first connection seat includes a first sub-seat and a second sub-seat, and the first sub-seat extends to form a limiting flange in a direction of the second sub-seat; and a part of a side wall of the second connection seat fits with an inner wall of the limiting flange. The side wall of the second connection seat abuts against the inner wall of the limiting flange to implement self-locking.

11 Claims, 4 Drawing Sheets

(56) References Cited

U.S. PATENT DOCUMENTS

| | | | | |
|---|---|---|---|---|
| 6,905,166 | B2 * | 6/2005 | Zhurong | A47B 3/0912 108/132 |
| 7,032,711 | B1 * | 4/2006 | Katz | B25H 3/06 248/238 |
| 7,506,923 | B1 * | 3/2009 | Gauss | B64D 11/0638 297/154 |
| 8,322,290 | B1 * | 12/2012 | Mignano | A47B 23/043 248/456 |
| 8,379,382 | B2 * | 2/2013 | Marshall | F16M 11/105 206/320 |
| 8,469,148 | B2 * | 6/2013 | Perry | E06C 7/14 248/240.4 |
| 10,201,232 | B2 * | 2/2019 | Melaragno | A47B 23/02 |
| D871,705 | S * | 12/2019 | Richards | D32/55 |
| 11,304,510 | B1 * | 4/2022 | Fernandes | A47B 13/16 |
| 11,485,538 | B1 * | 11/2022 | Cacciabeve | B65D 43/164 |
| 2008/0289094 | A1 * | 11/2008 | Blom | A47K 3/004 211/184 |
| 2022/0007089 | A1 * | 1/2022 | Claessens | H04Q 1/021 |

FOREIGN PATENT DOCUMENTS

| | | | | |
|---|---|---|---|---|
| CN | 215227053 | U * | 12/2021 | A47K 3/004 |
| CN | 114468819 | A * | 5/2022 | A47K 3/004 |
| DE | 0360956 | A1 * | 4/1990 | A47K 3/3004 |
| DE | 102019103327 | A1 * | 11/2019 | A47B 3/083 |
| KR | 200349688 | Y1 * | 5/2004 | A47K 3/004 |
| KR | 20190002034 | U * | 8/2019 | A47K 3/004 |

* cited by examiner

A

B

FOLDABLE BATHTUB TRAY

CROSS REFERENCE TO RELATED APPLICATIONS

The present application claims the benefit of Chinese Patent Application No. 202422066540.1 filed on Aug. 23, 2024, the contents of which are incorporated herein by reference in their entirety.

TECHNICAL FIELD

The present invention belongs to the field of bathtub tray technologies, and in particular, relates to a foldable bathtub tray.

BACKGROUND

A bathtub tray is an auxiliary tool for placing articles in or on the edge of a bathtub. Modern bathtub trays are widely used in home and business environments.

To facilitate storage of the bathtub tray, two support plates are usually connected together by using a hinge or a hinged structure in some existing foldable bathtub trays, to implement folding and unfolding functions of the trays. After the tray is unfolded, the support plate may be accidentally folded under uneven force or external force. This situation easily causes articles placed on the support plate to slide off or be damaged, and a safety hazard is particularly obvious when the tray bears heavy articles. Alternatively, an additional locking mechanism is provided to prevent accidental folding of the support plate. In the conventional technology, additional locking mechanisms usually need to be disposed, which may include a snap-fit, a pin, a bolt, and the like. These locking structures increase complexity of the trays, and may further affect operation convenience of a user, especially in a case of frequent unfolding and storage, which may easily cause accidental folding due to improper locking.

SUMMARY

The present invention provides a foldable bathtub tray, aiming to resolve a problem that an existing bathtub tray is difficult to operate because the bathtub tray has no locking mechanism or the locking mechanism has a complicated structure, which may lead to scattering and damage of articles due to accidental folding of a support plate.

The present invention is implemented in the following way. A foldable bathtub tray includes a first support plate and a second support plate, and the first support plate and the second support plate are hinged by using a connection assembly;

- the connection assembly includes a first connection seat, a second connection seat, and a rotating shaft;
- the first connection seat includes a first sub-seat and a second sub-seat, the first sub-seat extends to form a limiting flange in a direction of the second sub-seat, and the rotating shaft is fixedly connected between the first sub-seat and the second sub-seat; and
- the second connection seat is disposed between the limiting flange and the second sub-seat, a part of a side wall of the second connection seat fits with an inner wall of the limiting flange, and the second connection seat is in clearance fit with the rotating shaft.

Optionally, the second connection seat is in a columnar shape with a major arc bow, the limiting flange is in a columnar shape with a minor arc bow, and the second connection seat and the limiting flange are capable of being combined into a cylinder.

Optionally, lightening grooves are provided on the first sub-seat, the second sub-seat, and the second connection seat.

Optionally, a protruding clamping protrusion is disposed on the first support plate, a concave buckle is disposed on the second support plate at a location corresponding to the clamping protrusion, and the clamping protrusion fits with the concave buckle.

Optionally, a protruding clamping protrusion is disposed on the second support plate, a concave buckle is disposed on the first support plate at a location corresponding to the clamping protrusion, and the clamping protrusion fits with the concave buckle.

Optionally, a groove is provided on the clamping protrusion, an extension direction of the groove is consistent with an extension direction of the rotating shaft, the concave buckle includes an accommodating groove and a protruded block disposed in the accommodating groove, and the protruded block fits with the groove.

Optionally, a pull bracket is separately disposed on the first support plate and the second support plate, and the pull bracket is separately slidably connected to the first support plate and the second support plate.

Optionally, the pull bracket includes an adjustment portion and a support portion, a sliding groove is provided on the adjustment portion, a sliding block that fits with the sliding groove is disposed on the first support plate and the second support plate, and the support portion extends from an outer edge of the adjustment portion in a direction away from the first support plate and the second support plate.

Optionally, a fence is disposed on the first support plate and the second support plate.

Optionally, a mobile phone holder is disposed on the first support plate or the second support plate.

The present invention achieves the following beneficial effects: Because the first support plate and the second support plate are hinged, the first support plate and the second support plate can be folded for storage, to reduce a storage area. When the first support plate and the second support plate are unfolded, the second connection seat rotates to a location fitting with the limiting flange, the second connection seat slides along the rotating shaft, so that the side wall of the second connection seat abuts against the inner wall of the limiting flange, and the first support plate and the second support plate are fastened to implement self-locking. Therefore, the first support plate and the second support plate cannot be folded through rotation, thereby preventing articles placed on the first support plate and the second support plate from falling and being damaged due to folding of the first support plate and the second support plate in a use process.

REFERENCE NUMERALS

Figure 1:
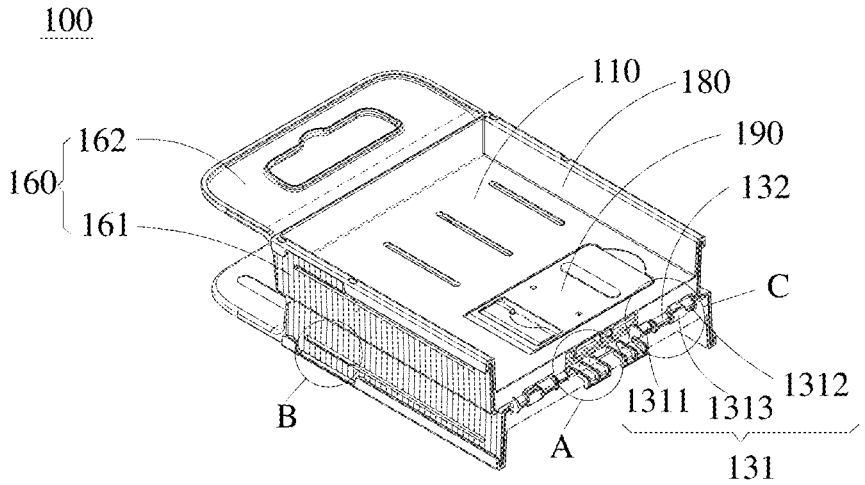
FIG. 1 is a schematic diagram of a structure of a foldable bathtub tray in a folded state according to the present invention.

100. foldable bathtub tray; 110. first support plate; 120. second support plate; 130. connection assembly; 131. first connection seat; 1311. first sub-seat; 1312. second sub-seat; 1313. limiting flange; 132. second connection seat; 133. rotating shaft; 140. clamping protrusion; 141. groove; 150. concave buckle; 151. accommodating groove; 152. protruded block; 160. pull bracket; 161. adjustment portion; 162. support portion; 163. sliding groove; 170. sliding block; 180. fence; and 190. mobile phone holder.

DESCRIPTION OF EMBODIMENTS

To make the objectives, technical solutions, and advantages of the present invention clearer, the following further describes the present invention in detail with reference to the accompanying drawings and the embodiments. Examples of the embodiments are shown in the accompanying drawings. The same or similar numerals represent the same or similar elements or elements having the same or similar functions throughout the specification. The embodiments described below with reference to the accompanying drawings are examples, and are only used to explain the present invention but should not be construed as a limitation to the present invention. In addition, it should be understood that specific embodiments described herein are merely used to explain the present invention, and are not used to limit the present invention.

In the description of the present invention, it should be understood that the orientation or location relationships indicated by the terms "length", "width", "up", "down", "left", "right", "horizontal", "top", "bottom", and the like are based on the orientation or location relationships shown in the accompanying drawings, and are only for ease of describing the present invention and simplifying the description, rather than indicating or implying that the mentioned apparatus or element needs to have a specific orientation or be constructed and operated in a specific orientation. Therefore, such terms should not be construed as a limitation to the present invention.

In addition, the terms such as "first" and "second" are merely used for description purposes, and shall not be understood as indicating or implying relative importance or implicitly indicating a quantity of indicated technical features. Therefore, features defined with "first" and "second" may explicitly or implicitly include one or more of the features. In the description of the present invention, "a plurality of" means two or more, unless otherwise explicitly and specifically limited.

In the description of the present invention, it should be noted that, unless otherwise specified and limited explicitly, the terms "mount", "connect", and "connection" should be understood in a broad sense, for example, may be a fixed connection, a detachable connection, or an integrated connection; may be a mechanical connection, an electrical connection, or intercommunication; may be a direct connection or an indirect connection by using an intermediate medium; or may be communication between two elements or interaction between two elements. A person of ordinary skill in the art can understand specific meanings of these terms in the present invention based on specific situations.

In the present invention, unless otherwise specified and limited explicitly, that a first feature is "above" or "below" a second feature may include direct contact between the first feature and the second feature, or may include indirect contact between the first feature and the second feature by using another feature between the first feature and the second feature. In addition, that the first feature is "above", "over", and "on" the second feature includes that the first feature is directly above and diagonally above the second feature, or only indicates that a level of the first feature is higher than that of the second feature. That the first feature is "below", "under", and "underneath" the second feature includes that the first feature is directly below and diagonally below the second feature, or only indicates that a level of the first feature is lower than that of the second feature.

The following disclosure provides many different embodiments or examples for implementing different structures of the present invention. To simplify the disclosure of the present invention, components and settings of specific examples are described below. Certainly, they are merely examples and are not intended to limit the present invention. In addition, in the present invention, reference numbers and/or reference letters may be repeated in different examples for simplicity and clarity purposes, and do not indicate a relationship between various embodiments and/or settings discussed. In addition, the present invention provides examples of various specific processes and materials, but a person of ordinary skill in the art may be aware of applications of other processes and/or uses of other materials.

In the present invention, a first support plate and a second support plate are hinged, and the first support plate and the second support plate can be folded for storage, to reduce a storage area. When the first support plate and the second support plate are unfolded, the second connection seat rotates to a location fitting with the limiting flange, the second connection seat slides along the rotating shaft, so that the side wall of the second connection seat abuts against the inner wall of the limiting flange, and the first support plate and the second support plate are fastened to implement self-locking. Therefore, the first support plate and the second support plate cannot be folded through rotation, thereby preventing articles placed on the first support plate and the second support plate from falling and being damaged due to folding of the first support plate and the second support plate in a use process.

Embodiment 1

As shown in FIG. 1 to FIG. 8, this embodiment provides a foldable bathtub tray 100, including: a first support plate 110 and a second support plate 120. The first support plate 110 and the second support plate 120 are hinged by using a connection assembly 130.

The connection assembly 130 includes a first connection seat 131, a second connection seat 132, and a rotating shaft 133.

The first connection seat 131 includes a first sub-seat 1311 and a second sub-seat 1312. The first sub-seat 1311 extends to form a limiting flange 1313 in a direction of the second sub-seat 1312, and the rotating shaft 133 is fixedly connected between the first sub-seat 1311 and the second sub-seat 1312.

The second connection seat 132 is disposed between the limiting flange 1313 and the second sub-seat 1312, a part of a side wall of the second connection seat 132 fits with an inner wall of the limiting flange 1313, and the second connection seat 132 is in clearance fit with the rotating shaft 133.

The first support plate 110 and the second support plate 120 are main load-bearing parts of the bathtub tray, and respectively form two support surfaces of the bathtub tray, for placing articles. The first support plate 110 and the second support plate 120 are hinged by using the connection assembly 130, and the first support plate 110 and the second support plate 120 may be rotated, folded, or unfolded relative to a hinged location. When being unfolded, the first support plate 110 and the second support plate 120 are assembled into a whole, and may be horizontally placed between two opposite side walls of a bathtub, for placing articles.

The first support plate 110 and the second support plate 120 are hinged by using the connection assembly 130, and the first connection seat 131 and the second connection seat 132 are respectively connected to the first support plate 110 and the second support plate 120. Specifically, it may be that the first connection seat 131 is disposed on the first support plate 110, and the second connection seat 132 is disposed on the second support plate 120; or it may be that the first connection seat 131 is disposed on the second support plate 120, and the second connection seat 132 is disposed on the first support plate 110. When a plurality of connection assemblies 130 are disposed, it may be further that, in at least one connection assembly 130, the first connection seat 131 is disposed on the first support plate 110, and the second connection seat 132 is disposed on the second support plate 120, and in the remaining connection assemblies 130, the first connection seat 131 is disposed on the second support plate 120, and the second connection seat 132 is disposed on the first support plate 110.

The first connection seat 131 includes the first sub-seat 1311 and the second sub-seat 1312, providing a basis for fastening and rotation. The rotating shaft 133 is fixedly connected between the first sub-seat 1311 and the second sub-seat 1312, providing a rotation fulcrum.

The second connection seat 132 cooperates with the first connection seat 131 for working, and the first sub-seat 1311 extends to form the limiting flange 1313, to form a limit to the second connection seat 132. The second connection seat 132 is in clearance fit with the rotating shaft 133, to ensure that the second connection seat 132 has a specific degree of freedom when rotating relative to the rotating shaft 133 but does not become loose. The second connection seat 132 is located between the limiting flange 1313 and the second sub-seat 1312, and a part of the side wall of the second connection seat 132 fits with the inner wall of the limiting flange 1313. When the second connection seat 132 rotates to an angle corresponding to the side wall of the second connection seat 132 and the inner wall of the limiting flange 1313, the limiting flange 1313 provides a limit and a guide for the second connection seat 132. In this case, the second connection seat 132 no longer rotates relative to the rotating shaft 133, but moves in an axial direction of the rotating shaft 133.

In this embodiment, the first support plate 110 and the second support plate 120 are hinged, and the first support plate 110 and the second support plate 120 can be folded for storage, to reduce a storage area. When the first support plate 110 and the second support plate 120 are unfolded, the second connection seat 132 rotates to a location fitting with the limiting flange 1313, the second connection seat 132 slides along the rotating shaft 133, so that the side wall of the second connection seat 132 abuts against the inner wall of the limiting flange 1313, and the first support plate 110 and the second support plate 120 are fastened to implement self-locking. Therefore, the first support plate 110 and the second support plate 120 cannot be folded through rotation, thereby preventing articles placed on the first support plate 110 and the second support plate 120 from falling and being damaged due to folding of the first support plate 110 and the second support plate 120 in a use process.

Embodiment 2

Figure 7:
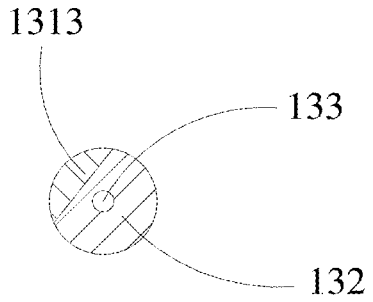
FIG. 7 is a schematic diagram of fit between a second connection seat and a limiting flange according to the present invention.
Figure 8:
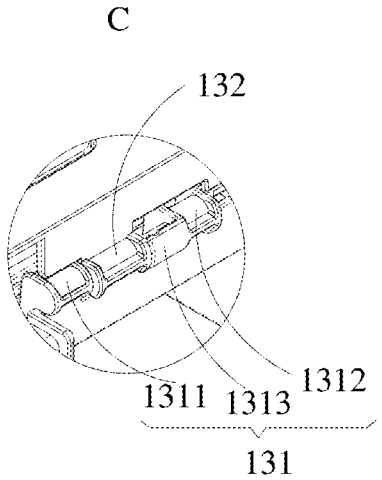
FIG. 8 is an enlarged schematic diagram of C.

As shown in FIG. 7, on a basis of Embodiment 1, the second connection seat 132 is in a columnar shape with a major arc bow, the limiting flange 1313 is in a columnar shape with a minor arc bow, and the second connection seat 132 and the limiting flange 1313 are capable of being combined into a cylinder.

A pattern consisted of a chord and an arc corresponding to the chord is called a bow. When being smaller than a semicircle, an arc of the bow is called a "minor arc bow". When being larger than the semicircle, an arc of the bow is called a "major arc bow".

A side wall corresponding to a chord of a major arc bow of the second connection seat 132 fits with an inner wall corresponding to a chord of a minor arc bow of the limiting flange 1313, and the two may be fitted together and combined into a cylinder.

The second connection seat 132 is disposed between the limiting flange 1313 and the second sub-seat 1312, and is provided with a limit by the limiting flange 1313 and the second sub-seat 1312. The second connection seat 132 may rotate around the rotating shaft 133, so that the second support plate 120 is folded or unfolded toward the first support plate 110. When the second connection seat 132 rotates to a location at which the side wall corresponding to the chord of the major arc bow fits with the inner wall corresponding to the chord of the minor arc bow of the limiting flange 1313, the second connection seat 132 can move in the axial direction of the rotating shaft 133, and the second connection seat 132 cannot rotate around the rotating shaft 133 due to blocking of the limiting flange 1313.

Embodiment 3

As shown in FIG. 1, on a basis of Embodiment 1, lightening grooves are provided on the first sub-seat 1311, the second sub-seat 1312, and the second connection seat 132.

A main function of the lightening groove is to reduce an overall weight of a component by reducing a quantity of materials used. This can effectively reduce a weight of the bathtub tray while maintaining structural strength, thereby improving portability of a product. In addition, design of the lightening groove can reduce the quantity of the materials used and reduce production costs. In particular, this design can bring obvious economic benefits in large-scale production.

Embodiment 4

On a basis of Embodiment 1, a protruding clamping protrusion 140 is disposed on the first support plate 110, a concave buckle 150 is disposed on the second support plate 120 at a location corresponding to the clamping protrusion 140, and the clamping protrusion 140 fits with the concave buckle 150.

The clamping protrusion 140 is a part protruding outward on the first support plate 110, and the concave buckle 150 is a concave part corresponding to the clamping protrusion 140. A size of the clamping protrusion 140 matches that of the concave buckle 150, so that the clamping protrusion 140 can be firmly embedded in the concave buckle 150.

When the first support plate 110 and the second support plate 120 are unfolded, and a part of the side wall of the second connection seat 132 abut against the inner wall of the limiting flange 1313, the clamping protrusion 140 is in snap fit with the concave buckle 150 to provide additional mechanical locking, which helps fasten the first support plate 110 and the second support plate 120, thereby preventing the first support plate 110 and the second support plate 120 from sliding or loosening in a use process, and ensuring structural stability and reliability.

Embodiment 5

Figure 5:
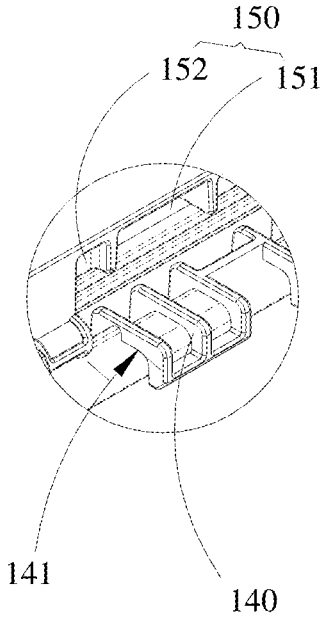
FIG. 5 is an enlarged schematic diagram of A.
Figure 6:
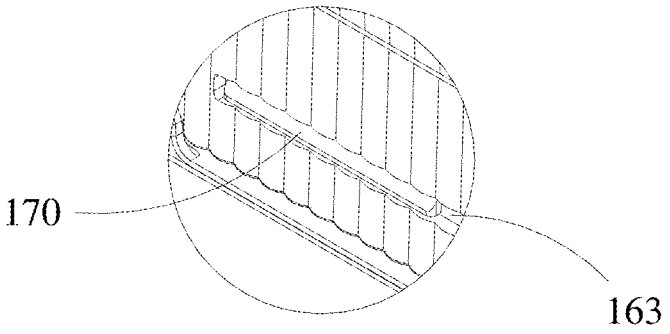
FIG. 6 is an enlarged schematic diagram of B.

As shown in FIG. 1 and FIG. 5, on a basis of Embodiment 1, a protruding clamping protrusion 140 is disposed on the second support plate 120, a concave buckle 150 is disposed on the first support plate 110 at a location corresponding to the clamping protrusion 140, and the clamping protrusion 140 fits with the concave buckle 150.

In comparison with Embodiment 4, the clamping protrusion 140 is disposed on the second support plate 120 and the concave buckle 150 is disposed on the first support plate 110, and a manner of using the clamping protrusion 140 and the concave buckle 150 is the same as that in Embodiment 4. Details are not described herein again.

Embodiment 6

As shown in FIG. 5, on a basis of Embodiment 4 or Embodiment 5, a groove 141 is provided on the clamping protrusion 140, an extension direction of the groove 141 is consistent with an extension direction of the rotating shaft 133, the concave buckle 150 includes an accommodating groove 151 and a protruded block 152 disposed in the accommodating groove 151, and the protruded block 152 fits with the groove 141.

Specifically, the accommodating groove 151 is configured to accommodate the clamping protrusion 140, and a width of the accommodating groove 151 is greater than a width of the clamping protrusion 140. The protruded block 152 protrudes from a side wall on one side of the accommodating groove 151 to a side wall on the other side, and a protruding direction of the protruded block 152 is consistent with an extension direction of the limiting flange 1313.

When the second connection seat 132 moves along an axial line of the rotating shaft 133 and abuts against the limiting flange 1313, the clamping protrusion 140 moves along the axial line of the rotating shaft 133 accordingly, and the groove 141 on the clamping protrusion 140 is in snap fit with the protruded block 152 to provide additional mechanical locking, which helps fasten the first support plate 110 and the second support plate 120, thereby preventing the first support plate 110 and the second support plate 120 from sliding or loosening in a use process, and ensuring structural stability and reliability.

It should be noted that, in this embodiment, a width direction is consistent with an axial extension direction of the rotating shaft 133.

Embodiment 7

As shown in FIG. 1 to FIG. 4, on a basis of Embodiment 1, a pull bracket 160 is separately disposed on the first support plate 110 and the second support plate 120, and the pull bracket 160 is separately slidably connected to the first support plate 110 and the second support plate 120.

The pull bracket 160 is separately mounted on the first support plate 110 and the second support plate 120, and the pull bracket 160 is separately slidably connected to the first support plate 110 and the second support plate 120, to freely slide within a specific range. A user may manually stretch or shorten the pull bracket 160 as needed, to lengthen or shorten a length of a support plate, thereby adjusting a size of the entire bathtub tray to meet different use requirements.

A slidable connection is specifically implemented by using a track, a sliding groove 163, a guide rail system, or the like. This is not limited herein.

Embodiment 8

As shown in FIG. 1 to FIG. 4, on a basis of Embodiment 1, the pull bracket 160 includes an adjustment portion 161 and a support portion 162, the sliding groove 163 is provided on the adjustment portion 161, a sliding block 170 that fits with the sliding groove 163 is disposed on the first support plate 110 and the second support plate 120, and the support portion 162 extends from an outer edge of the adjustment portion 161 in a direction away from the first support plate 110 and the second support plate 120.

The adjustment portion 161 is responsible for connecting to and sliding with the first support plate 110 and the second support plate 120. One or more sliding grooves 163 are designed on the adjustment portion 161, and the sliding grooves 163 extend in a length direction of the support portion 162, to guide movement of the sliding block 170. Design of the sliding groove 163 may be linear, or may have a specific curve or shape, which specifically depends on a use requirement of the pull bracket 160. The sliding block 170 is fastened to the first support plate 110 and the second support plate 120, and fits with the sliding groove 163 of the adjustment portion 161. The support portion 162 extends from the outer edge of the adjustment portion 161 in the direction away from the first support plate 110 and the second support plate 120. When relative movement occurs between the sliding groove 163 and the sliding block 170, the support portion 162 moves accordingly, to extend or shorten a length of the pull bracket 160, to adapt to a specific use scenario.

Embodiment 9

Figure 2:
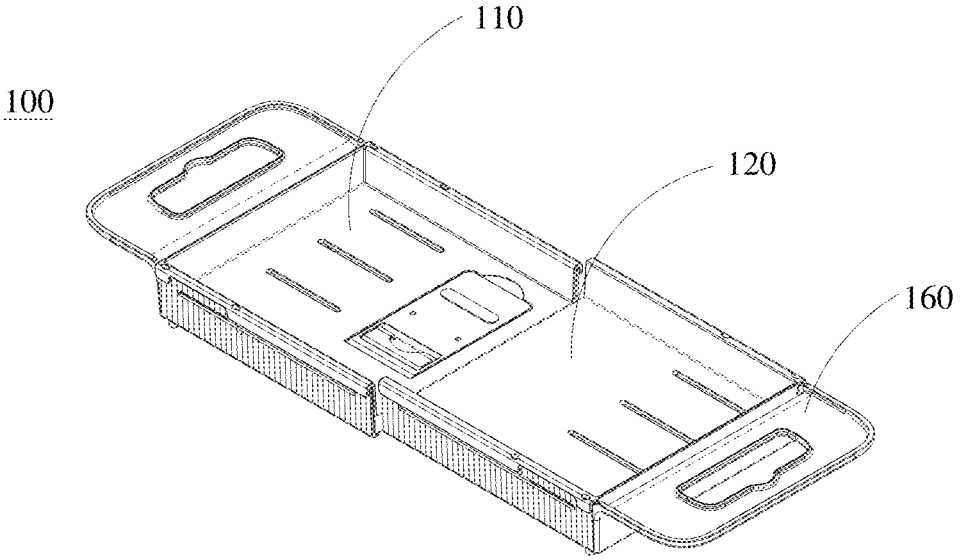
FIG. 2 is a schematic diagram of a structure of a foldable bathtub tray in an unfolded state according to the present invention.
Figure 3:
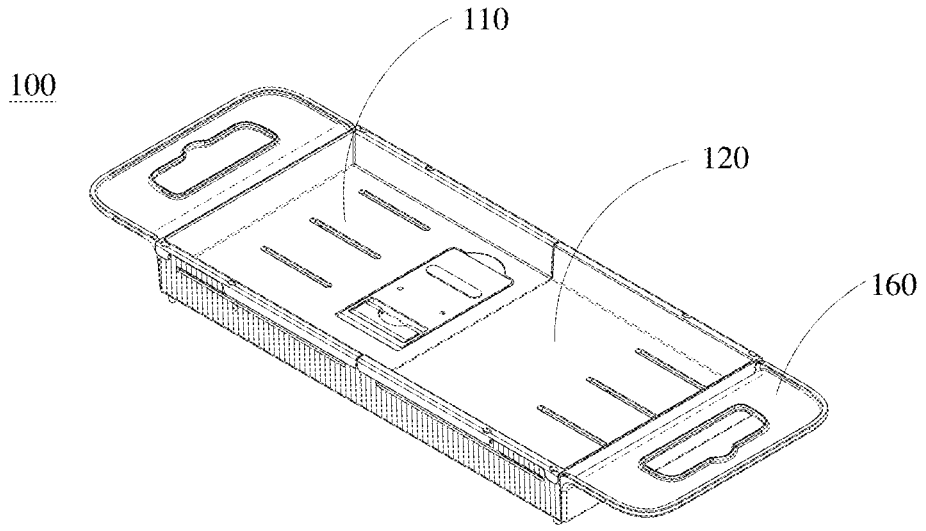
FIG. 3 is a schematic diagram of a structure of a foldable bathtub tray in a locked state according to the present invention.
Figure 4:
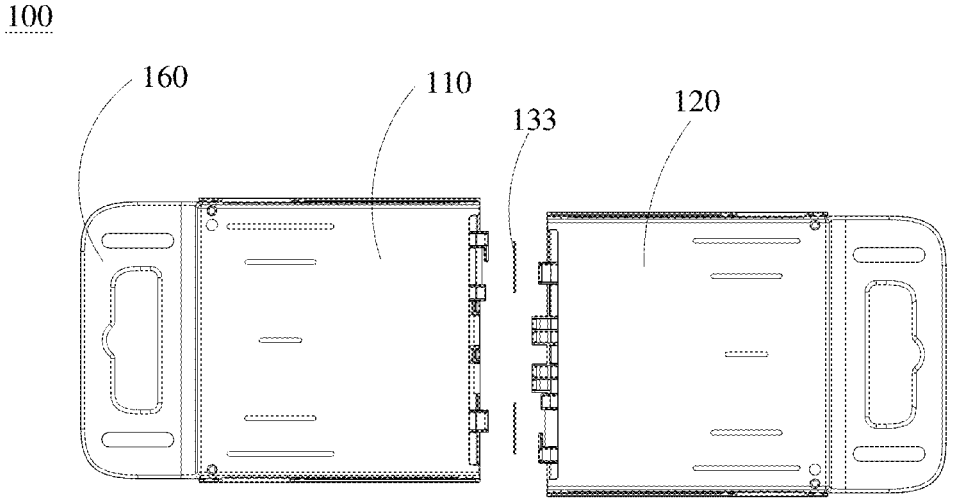
FIG. 4 is a bottom view of a foldable bathtub tray in splitting according to the present invention.

As shown in FIG. 1 to FIG. 3, on a basis of Embodiment 1, a fence 180 is disposed on the first support plate 110 and the second support plate 120.

The fence 180 is disposed on peripheral edges of the first support plate 110 and the second support plate 120, and forms a closed or semi-closed structure around outer edges of the support plates. The fence 180 may be fixed, or may be detachable or foldable, depending on a design requirement of a product.

The fence 180 can provide protection. Especially, when articles are placed on the support plate, the fence 180 can help fasten the articles and prevent the articles from accidentally sliding off.

Embodiment 10

As shown in FIG. 1 to FIG. 3, on a basis of Embodiment 1, a mobile phone holder 190 is disposed on the first support plate 110 or the second support plate 120.

The mobile phone holder 190 is configured to support a mobile phone or another electronic device. The mobile phone holder may be specifically a fixed mobile phone holder 190, or may be a foldable mobile phone holder 190.

Specifically, the mobile phone holder 190 may be the foldable mobile phone holder 190. The foldable mobile phone holder 190 usually includes a plurality of foldable support arms. The support arms may be folded flat when not in use, and unfolded to support the mobile phone when needed, which are convenient for storage. The mobile phone holder may alternatively be a clamping bracket usually including two or more adjustable clamping arms, and the clamping arms may be adjusted by a spring or a screw mechanism to accommodate mobile phones of different sizes. The mobile phone holder may alternatively be a mobile phone holder 190 in another common structure. Details are not described herein.

The mobile phone holder 190 may be fixedly connected or movably connected to the first support plate 110 or the second support plate 120. Setting of the mobile phone holder 190 enables the user to conveniently use the mobile phone or another electronic product during a bath, which can significantly improve use experience of the bathtub tray.

The above descriptions are merely preferred embodiments of the present invention, and are not intended to limit the present invention. Any modification, equivalent substitute, and improvement made without departing from the spirit and principle of the present invention shall be included within the protection scope of the present invention.

What is claimed is:

1. A foldable bathtub tray, comprising a first support plate and a second support plate, wherein the first support plate and the second support plate are hinged by using a connection assembly;

the connection assembly comprises a first connection seat, a second connection seat, and a rotating shaft;

the first connection seat comprises a first sub-seat and a second sub-seat, the first sub-seat extends to form a limiting flange in a direction of the second sub-seat, and the rotating shaft is fixedly connected between the first sub-seat and the second sub-seat; and the second connection seat is disposed between the limiting flange and the second sub-seat, a part of a side wall of the second connection seat fits with an inner wall of the limiting flange, and the second connection seat is in clearance fit with the rotating shaft, when the first support plate and the second support plate are being unfolded, the second connection seat is rotatable to a location fitting with the limiting flange, the second connection seat is further slidable along the rotating shaft, so that the side wall of the second connection seat abuts against the inner wall of the limiting flange, and the first support plate and the second support plate are fastened to implement self-locking.

2. The foldable bathtub tray according to claim 1, wherein the second connection seat is in a columnar shape with a major arc bow, the limiting flange is in a columnar shape with a minor arc bow, and the second connection seat and the limiting flange are capable of being combined into a cylinder.

3. The foldable bathtub tray according to claim 1, wherein lightening grooves are provided on the first sub-seat, the second sub-seat, and the second connection seat.

4. The foldable bathtub tray according to claim 1, wherein a protruding clamping protrusion is disposed on the first support plate, a concave buckle is disposed on the second support plate at a location corresponding to the clamping protrusion, and the clamping protrusion fits with the concave buckle.

5. The foldable bathtub tray according to claim 1, wherein a protruding clamping protrusion is disposed on the second support plate, a concave buckle is disposed on the first support plate at a location corresponding to the clamping protrusion, and the clamping protrusion fits with the concave buckle.

6. The foldable bathtub tray according to claim 4, wherein a groove is provided on the clamping protrusion, an extension direction of the groove is consistent with an extension direction of the rotating shaft, the concave buckle comprises an accommodating groove and a protruded block disposed in the accommodating groove, and the protruded block fits with the groove.

7. The foldable bathtub tray according to claim 1, wherein a pull bracket is separately disposed on the first support plate and the second support plate, and the pull bracket is separately slidably connected to the first support plate and the second support plate.

8. The foldable bathtub tray according to claim 7, wherein the pull bracket comprises an adjustment portion and a support portion, a sliding groove is provided on the adjustment portion, a sliding block fits with the sliding groove is disposed on the first support plate and the second support plate, and the support portion extends from an outer edge of the adjustment portion in a direction away from the first support plate and the second support plate.

9. The foldable bathtub tray according to claim 1, wherein a fence is disposed on the first support plate and the second support plate.

10. The foldable bathtub tray according to claim 1, wherein a mobile phone holder is disposed on the first support plate or the second support plate.

11. The foldable bathtub tray according to claim 5, wherein a groove is provided on the clamping protrusion, an extension direction of the groove is consistent with an extension direction of the rotating shaft, the concave buckle comprises an accommodating groove and a protruded block disposed in the accommodating groove, and the protruded block fits with the groove.

* * * * *